US006980957B1

(12) United States Patent
Baumgartner et al.

(10) Patent No.: US 6,980,957 B1
(45) Date of Patent: Dec. 27, 2005

(54) AUDIO TRANSMISSION SYSTEM WITH REDUCED BANDWIDTH CONSUMPTION

(75) Inventors: Jason Raymond Baumgartner, Austin, TX (US); Nadeem Malik, Austin, TX (US); Steven Leonard Roberts, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/460,830

(22) Filed: Dec. 14, 1999

(51) Int. Cl.[7] ..... G10L 21/04
(52) U.S. Cl. ..... 704/500
(58) Field of Search ..... 704/500

(56) References Cited

U.S. PATENT DOCUMENTS 5,153,591 A * 10/1992 Clark ..... 341/51
5,323,155 A * 6/1994 Iyer et al. ..... 341/106
5,424,732 A * 6/1995 Iyer et al. ..... 341/51
6,088,699 A * 7/2000 Gampper et al. ..... 341/106

* cited by examiner

*Primary Examiner*—Angela A. Armstrong
(74) *Attorney, Agent, or Firm*—Joseph P. Lally; Mark E. McBurney

(57) ABSTRACT

An audio transmission system and an associated method are disclosed, the system includes a transmitting device suitable for converting an audio signal to a digitized signal, a receiving device suitable for receiving transmissions from the transmitting device, and a phonetic analyzer suitable for comparing the digitized signal to a set of digitized signals stored in a first dictionary. The phonetic analyzer is adapted to transmit, in lieu of the digitized signal, an index value associated with the digitized signal to a receiving device in response to detecting a match between the digitized signal and one of the first dictionary entries. The phonetic analyzer is further adapted to assign an index value to the digitized signal and to store the digitized signal and its corresponding digitized signal in an entry of the first dictionary in response to detecting no match between the digitized signal and any of the first dictionary entries. The phonetic analyzer may be configured to compress the index value prior to transmission. The receiving device includes a second dictionary and a dictionary controller for receiving the index value and the corresponding digitized signal and for storing the index value and the corresponding index value in the second dictionary. Upon detecting an index value that matches to an index value in the second dictionary, the receiving device may be configured to retrieve the corresponding digitized signal from the second dictionary. The phonetic analyzer may assign index values that are indicative of the corresponding digitized signals such that index values assigned to similar digitized signals are similar and index values assigned to dissimilar digitized signals are dissimilar. In this embodiment, upon detecting an index value that fails to match to an index value in the secondary dictionary, the dictionary controller determines a closest matching index value and retrieves the digitized signal corresponding to closest matching index value from the second dictionary.

21 Claims, 3 Drawing Sheets

AUDIO TRANSMISSION SYSTEM WITH REDUCED BANDWIDTH CONSUMPTION

BACKGROUND

1. Field of the Present Invention

The present invention is related to the field of audio systems and more particularly to a method and system for reducing bandwidth consumption in an audio system.

2. History of Related Art

Streaming audio signals over inconsistent and bandwidth-limited mediums is a difficult problem. In many designs, buffering schemes are employed to reduce the possibility of breaking the audio stream during playback. These buffers compensate for inconsistencies in the audio transmission rate. In these schemes, the size of the buffer is based upon an assumed minimum bandwidth. The receiving device can reproduce the audio signal from the front of the buffer as the audio signal streams into the back of the buffer. Unfortunately, the network frequently cannot produce the minimum required bandwidth for the necessary duration. When this occurs, the buffer empties and the audio stream playback is broken. The buffer must then be refilled, which requires a time that is proportional to the size of the buffer. While the buffer is refilling, the subscriber waits to hear the rest of the transmission. It is therefore beneficial to implement a method and system that reduce the bandwidth consumed by an audio signal thereby reducing the minimum bandwidth required to maintain an uninterrupted audio stream.

SUMMARY OF THE INVENTION

An audio transmission system and an associated method are disclosed to address the problem described above. The system includes a transmitting device suitable for converting an audio signal to a digitized signal, a receiving device suitable for receiving transmissions from the transmitting device, and a phonetic analyzer suitable for comparing the digitized signal to a set of digitized signals stored in a first dictionary. The phonetic analyzer is adapted to transmit, in lieu of the digitized signal, an index value associated with the digitized signal to a receiving device in response to detecting a match between the digitized signal and one of the first dictionary entries. The phonetic analyzer is further adapted to assign an index value to the digitized signal and to store the digitized signal and its corresponding digitized signal in an entry of the first dictionary in response to detecting no match between the digitized signal and any of the first dictionary entries. The phonetic analyzer may be configured to compress the index value prior to transmission. The receiving device includes a second dictionary and a dictionary controller for receiving the index value and the corresponding digitized signal and for storing the index value and the corresponding index value in the second dictionary. Upon detecting an index value that matches an index value in the second dictionary, the receiving device may be configured to retrieve the corresponding digitized signal from the second dictionary. The phonetic analyzer may assign index values that are indicative of the corresponding digitized signals such that index values assigned to similar digitized signals are similar and index values assigned to dissimilar digitized signals are dissimilar. In this embodiment, upon detecting an index value that fails to match to an index value in the secondary dictionary, the dictionary controller may determine a closest matching index value and retrieves the digitized signal corresponding to closest matching index value from the second dictionary.

BRIEF DESCRIPTION OF THE DRAWINGS

Other objects and advantages of the invention will become apparent upon reading the following detailed description and upon reference to the accompanying drawings in which.

Figure 1:
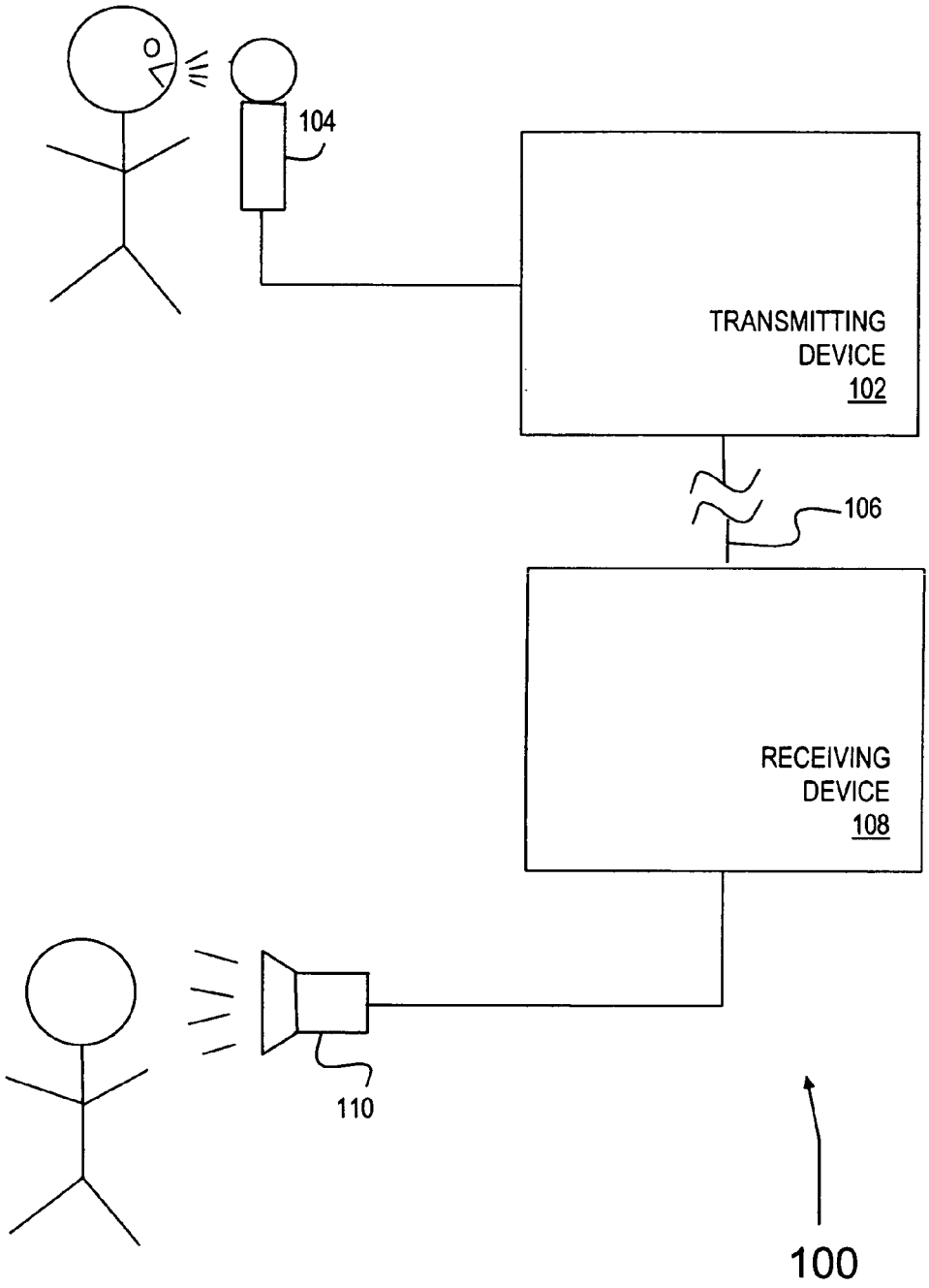
FIG. 1 is a simplified block diagram of a audio system according to one embodiment of the present invention.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF A PREFERRED EMBODIMENT OF THE PRESENT INVENTION

Turning now to FIG. 1, a high level block diagram of a system 100 for transmitting audio data is depicted. System 100 includes a transmitting device 102 configured to receive an audio signal from an audio input device such as a microphone 104. Transmitting device 102 is connected to a receiving device 108 with a transmission medium 106. Receiving device 108 is configured to generate an audio signal that is output over an audio output device such as speaker 110. The present invention contemplates reducing the bandwidth required of transmission medium 106 to accurately and reliably reproduce the audio signal received by microphone 104 at speaker 110. Although the depicted embodiment indicates a one-way transmission from transmitting device 102 to receiving device 108, that restriction is included for the purposes of simplifying the illustration and is not a limitation of the present invention. In other embodiments, transmitting device 102 and receiving device 108 are equally capable of receiving and transmitting audio signals to and from one another. The present invention is suitable for use in a variety of applications including applications in which the transmission medium 106 comprises the internet. As an example, an internet telephone application of the present invention contemplates a real time transmission of audio signals between parties with a minimum of delay and signal breakup.

Figure 2:
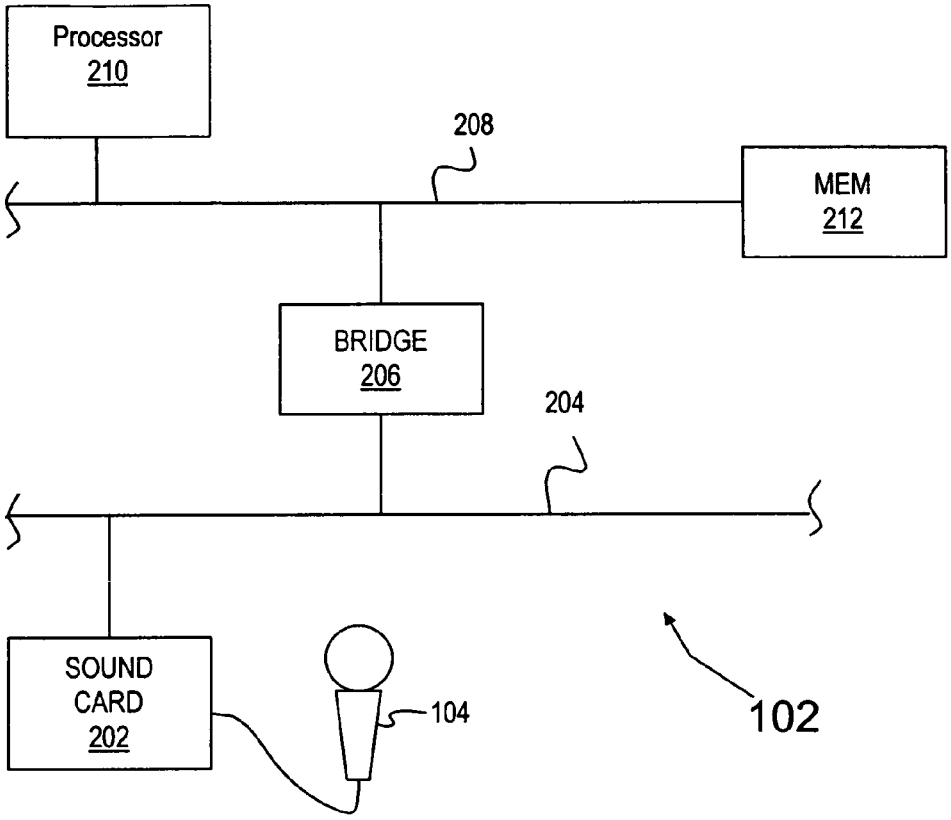
FIG. 2 is a block diagram of the transmitting device of the audio system of FIG. 1.

Turning now to FIG. 2, a block diagram of the transmitting device 102 of FIG. 1 is depicted. In the depicted embodiment, transmitting device 102 includes a sound card 202 to which an audio input device such as microphone 104 is connected. Sound card 202 quantizes or converts a received audio signal into a digital representation of the audio signal using well known audio digital signal processing techniques. The digital representation of the audio signal (referred to herein as the digitized signal) typically includes a set of 8-bit or 16-bit digital values. In the depicted embodiment, the sound card 202 comprises an I/O adapter of a microprocessor based data processing system 201 that includes one or more processors 210 connected to a system memory 212 via a system bus 208. Sound card 202 is connected to an I/O bus 204 of system 201. System bus 204 may be compliant with any of a variety of standardized peripheral busses including a PCI bus as defined in the PCI Local Bus Specification Rev. 2.2 available from the PCI Special Interest Group (www.pcisig.com) and incorporated by referenced herein. The I/O bus 204 is connected to system bus 208 via a bus bridge 206 as will be familiar to those in the field of microprocessor based computer design. Thus, in the embodiment depicted in FIG. 2, transmitting device 102 may comprise desktop personal computer, a network computer, or other suitable computing device. In another embodiment (not depicted) transmitting device 102 may comprise a sound card 202 in conjunction with a dedicated or embedded processor along with some memory.

Figure 3:
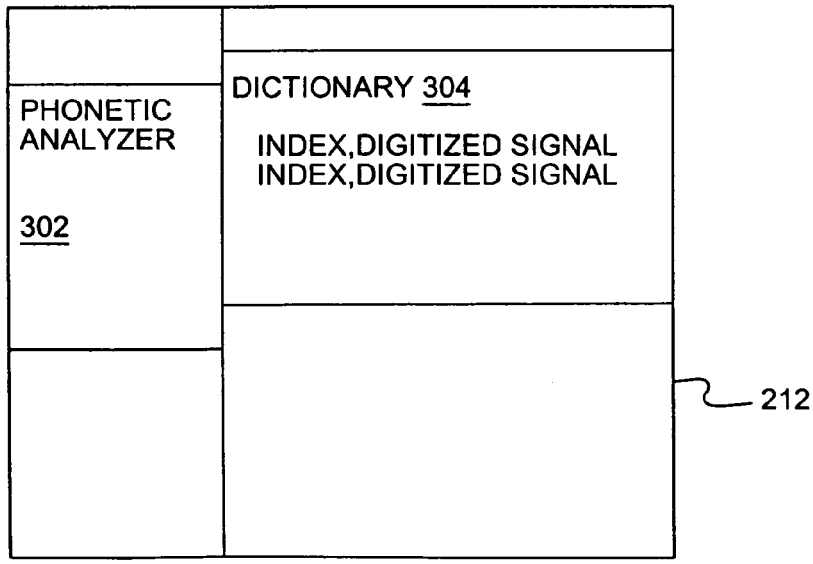
FIG. 3 is a representation of the memory of the transmitting device of FIG. 2.

Turning now to FIG. 3, a representative diagram of the memory 212 of transmitting device 102 is presented. Portions of the invention may be implemented as a set of computer instructions encoded on a computer readable medium such as a system memory, hard disk, floppy diskette, CD ROM, magnetic tape, or other suitable storage device. In the depicted embodiment, memory 212 contains a sequence of computer instruction executable by processor 210 that includes a phonetic analyzer 302. Phonetic analyzer 302 is adapted to recognize repeated occurrences of digitized signals produced by sound card 202. The digitized signal may correspond to an audio signal comprising a single phonetic sound or phonetic element (phoneme). Phonemes are combined to form more complex sounds such as words. Thus, phonemes may be thought of as the building blocks of speech audio communication. Human speech is characterized by a relatively small number of phonemes. Phonetic analyzer 302 is adapted to recognize repeated patterns of digital values produced by sound card 202 and to assign an integer value (referred to herein as an index value) to each recognized pattern. In this manner, phonetic analyzer 302 is adapted to build a library of phonemes, each with its own unique index value. When phonetic analyzer 302 receives a digitized signal of an audio signal that it has not previously encountered, analyzer 302 assigns an index value to the digitized signal and stores both the index value and its associated digitized signal in a dictionary referred to herein as local dictionary 304. The assigned index value, along with the corresponding digitized signal, are then transmitted to a remote device. In one embodiment, index values may be assigned in the order in which the corresponding phonemes are received. While this embodiment enjoys the advantage of simplicity, another embodiment might employ any of a variety of techniques to generate index values that, to some extent, reflect the audio characteristics of the corresponding phoneme. Using this approach, for example, the indexes of phonemes that are acoustically similar will have similar values. When phonetic analyzer 302 detects a sequence of digital values from sound card 202 that it recognizes as equivalent to one of the phonemes stored in local dictionary 304, the software is configured to retrieve the index value corresponding to the phoneme from dictionary 304 for transmission to a remote system.

In one embodiment, system 102 utilizes a segmented array for an efficient implementation. Phonetic analyzer 302 may be utilized to decompose speech into a sequence of symbols (one per phoneme). These symbols, represented as integers, may be used to indicate the segment of the array to be searched for a match or, in the case of a new phoneme, the segment into which a sample for the new phoneme will be inserted. In one embodiment, if a sample exists in dictionary 304 for a given symbol (as provided by phonetic analyzer 302), the index of this sample is transmitted regardless of any difference between the stored sample and the currently-spoken phoneme. Optionally, this "difference data" may be quantized and transmitted along with the index for more precise audio refinement on the receiving end. In another embodiment, several samples for the same symbolic phoneme may be stored if "sufficiently" dissimilar. The phonetic symbol (from phonetic analyzer 302) may define the region of the array in which to search or store a given sample. Within this region, when a new phoneme is spoken, a hashing or linear probing scheme may be utilized to search the given region for exact/near matches. If no matches are found, a new item is stored within this region.

Figure 4:
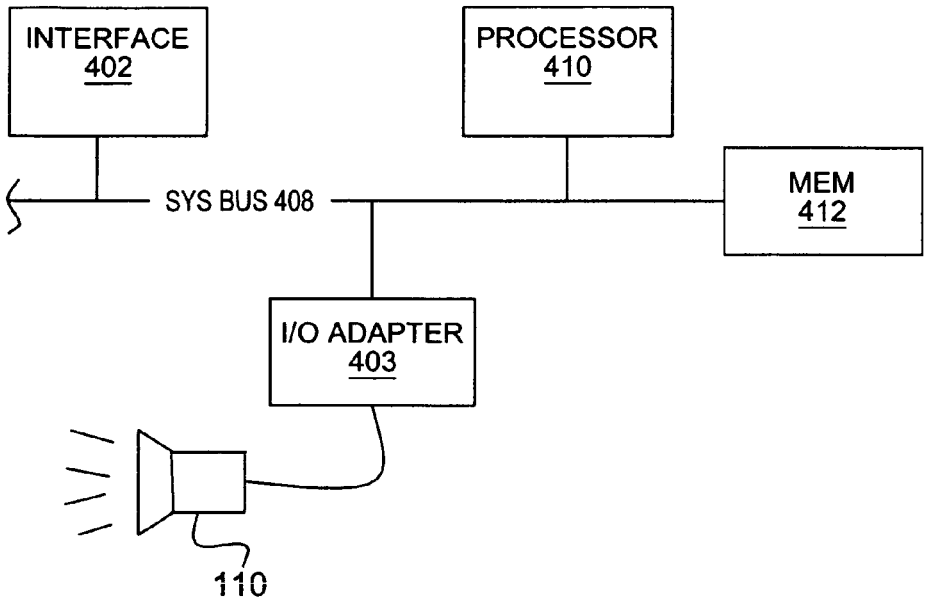
FIG. 4 is a block diagram of a receiving device according to one embodiment of the present invention.
Figure 5:
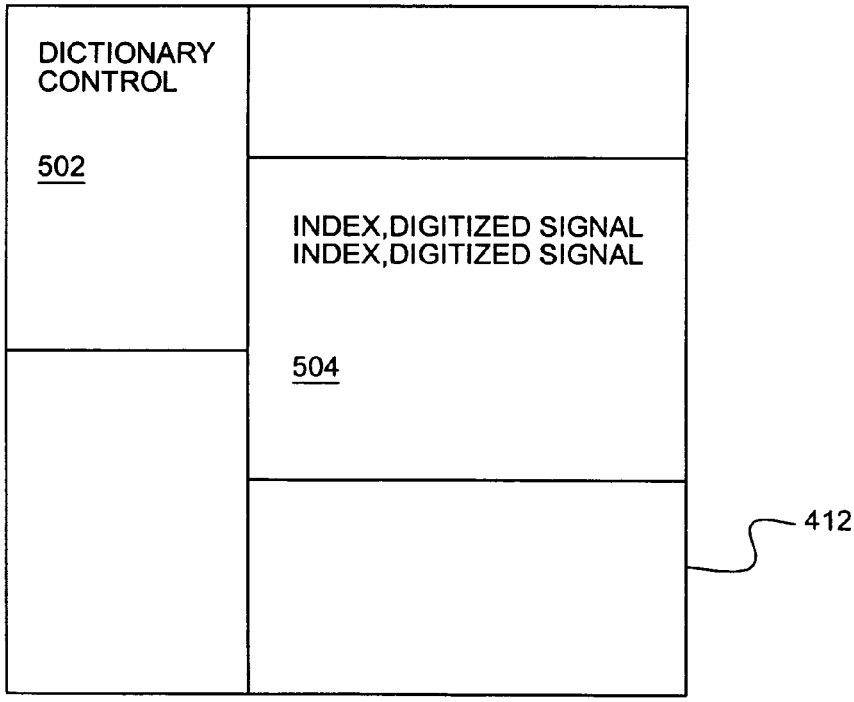
FIG. 5 is an illustration of one embodiment of a memory facility in the receiving device of FIG. 4.

Turning to FIG. 4, a simplified block diagram of a remote device (receiving device) 108 according to one embodiment of the invention is presented. In the depicted embodiment, receiving device 108 includes an interface unit 402 adapted to receive information from transmitting device 102 via transmission medium 106. The interface unit 402 is coupled to one or more processors 410 via a system bus 408. A system memory 412 of receiving device 108 is accessible to processors 410 via system bus 408. An I/O adapter 403 is connected to system bus 408 (either directly or through an intervening bus bridge) and is further connected to an audio output device such as speaker 110. Similar to transmitter device 102, receiving device 108 may comprise a conventional desktop computer, network computer, or other similar data processing system. The memory 412 of receiving device 108 shown in FIG. 5 includes a dictionary 504 (referred to herein as remote dictionary 504) in addition to dictionary control software 502. Dictionary control software 502 is suitable for determining whether information received from interface unit 402 comprise an index value, a phoneme in the form of a digitized signal, or both. The distinction between index values and phonemes may be signified by a preliminary bit, through the use of parity, or in any other suitable fashion. Upon determining that a received signal includes a phoneme, dictionary control software 502 creates a new entry in remote dictionary 504 and stores the digitized signal that comprise the phoneme along with the corresponding index value in the newly created entry. In this manner, the remote dictionary 504 in receiving device 108 is maintained as a mirror of the local dictionary 304 in transmitting device 102. If dictionary control software 502 determines that a signal received from transmitting device 102 represent an index value, rather than a phoneme, the control software 502 utilizes the index value to retrieve the digitized signal corresponding to the index value from remote dictionary 504. The digitized signal corresponding to the received index value is then forwarded to I/O adapter 403 and speaker 410 where the digitized signal is transformed to an audio signal at the remote station.

In an embodiment in which the transmission medium 106 comprises a lossy and unreliable transmission medium such as, for example, the internet one or more bits of an index value received by receiving device 108 may differ from the corresponding bits of the index values sent by transmitting device 102. In other words, index value bits may flip during transmission over transmission medium 106 due to noise, signal loss, or other mechanism. When this occurs, the received index value by receiving device 108 and the entries stored in remote dictionary 504. Under these circumstances, one embodiment of the invention contemplates dictionary control software 502 that selects the "closest" matching index value when a received index value has no exact match in remote dictionary 504. In this embodiment, it is further desirable if index values reflect the audio characteristics of the corresponding phoneme such that similar sounding phonemes have similar index values. Thus, if a single bit of an index value gets corrupted and the corrupted index happens to match an index in remote dictionary 504, the sound corresponding to the matching index and the sound corresponding to the original index are similar and the resulting sound that is communicated to the listener is not significantly different than the sound that was intended to be communicated. Since a corrupted index may seriously degrade the quality of the transmitted audio stream, an error correction protocol (including existing error correction protocols) may be employed in one embodiment to mandate the correction/retransmission of a corrupted index.

By assigning index values to phonetic elements as they are encountered and building mirroring phoneme dictionaries in transmitting device 102 and receiving device 108 and thereafter transmitting index values rather than the phonetic elements themselves, the present invention contemplates transmitting audio information with as sequence of index values that consume less bandwidth than the original signals. In an embodiment in which phonetic analyzer 302 incorporates sophisticated compaction algorithms such as Limpel-Zev, the phoneme dictionaries may be further increased to incorporate not only individual phonemes, but also combinations of phonemes such that, for example, whole words, multiple words, or even frequently encountered sentences may be represented by a single index value. In addition, the invention is compatible with existing data compression schemes such that the transmitted index values may be compressed versions of the actual index values to achieve an even greater reduction in transmission medium bandwidth consumption. One alternate embodiment of this system performs a pre-filtering of the audio before correlating with data in dictionary 306. For example, volume and pitch may be normalized, and frequencies may be limited through band-pass filtering. Such normalization is attractive, since it will decrease the dictionary size and effectively decrease the bandwidth of the transmitted dictionary entry. Moreover, in an embodiment where multiple samples are kept per phoneme, such normalization may decrease the amount of dissimilarity between unique samples of the same spoken phoneme. To utilize this technique in internet phone and cellular phone applications, where a higher degree of quality is expected, the transmission may include (in addition to the phoneme index), quantizations representing volume, pitch, etc., such that multiple voice signatures may be mapped to a single sample in the dictionary to achieve yet a more exact audio refinement at the receiving end.

Furthermore, the use of phoneme dictionaries may be extended to encompass an embodiment in which, for example, phoneme dictionaries are generated for each user. In this embodiment, morphologic analysis is performed on the audio information to identify the user. Thereafter, the phoneme dictionaries of that user are selected at both ends of the transmission medium such that the audio information generated at the receiving device replicates the voice qualities of the user. Another extension of the phoneme dictionaries might incorporate an email reader. In this application, email text is broken down into its component phonemes by a translation device. The phonemes are then converted to the appropriate index values and the phoneme dictionaries used to build audio sequences representative of the email text. In this manner, the recipient of an email message may choose to listen to the email message by converting it to an audio sequence. In a consumer oriented extension of this concept, the phoneme dictionaries of famous personalities could be commercially distributed such that the email message is spoken in the voice of the corresponding personality.

It will be apparent to those skilled in the art having the benefit of this disclosure that the present invention contemplates reduced bandwidth consumption in an audio transmission system. It is understood that the form of the invention shown and described in the detailed description and the drawings are to be taken merely as presently preferred examples. It is intended that the following claims be interpreted broadly to embrace all the variations of the preferred embodiments disclosed.

What is claimed is:

1. A method of transmitting audio information, comprising:

converting an audio signal to a digitized signal;

comparing the digitized signal to a set of digitized signal entries in a first dictionary, wherein each digitized signal entry is associated with a corresponding index value;

responsive to detecting a match between the digitized signal and one of the first dictionary entries, transmitting the index value in lieu of the digitized signal to a receiving device; and responsive to detecting no match between the digitized signal and any of the first dictionary entries, assigning an index value to the digitized signal and storing the digitized signal and the corresponding assigned index value in an entry of the first dictionary.

2. The method of claim 1, further comprising, compressing the index value prior to transmission.

3. The method of claim 1, further comprising receiving the index value and the corresponding digitized signal and storing the index value and the corresponding digitized signal in a second dictionary.

4. The method of claim 3, further comprising, upon receiving an index value that matches to an index value in the second dictionary, retrieving the corresponding digitized signal from the second dictionary.

5. The method of claim 3, wherein receiving the index value includes verifying the integrity of the index value with an error correction protocol.

6. The method of claim 1, wherein the index value assigned to a digitized signal is indicative of the digitized signal such that index values assigned to similar digitized signals are similar and index values assigned to dissimilar digitized signals are dissimilar.

7. The method of claim 3, wherein, upon detecting an index value that fails to match to an index value in the second dictionary, determining a closest matching index value and retrieving the digitized signal corresponding to the closest matching index value from the second dictionary.

8. The method of claim 1, further comprising:

assigning an index value to a sequence of digitized signals including a first digitized signal corresponding to a first entry in the first dictionary and a second digitized signal corresponding to a second entry in the digitized signal; and transmitting the index value to the receiving device in lieu of the sequence of digitized signals.

9. The method of claim 1, wherein converting the audio signal to the digitized signal includes pre-filtering the audio signal wherein the pre-filtering includes normalizing volume and pitch characteristics of the audio signal.

10. The method of claim 9, further comprising transmitting volume and pitch quantizations with the index value.

11. An audio transmission system, comprising:

a transmitting device suitable for converting an audio signal to a digitized signal;

a receiving device suitable for receiving transmissions from the transmitting device;

a phonetic analyzer suitable for comparing the digitized signal to a set of digitized signals stored in a first dictionary;

wherein the phonetic analyzer is adapted, responsive to detecting a match between the digitized signal and one of the first dictionary entries, transmitting an index value associated with the digitized signal in lieu of the digitized signal to a receiving device; and wherein the phonetic analyzer is further adapted, responsive to detecting no match between the digitized signal and any of the first dictionary entries, assigning an index value to the digitized signal and storing the digitized signal and the corresponding index value in an entry of the first dictionary.

12. The system of claim 11, wherein the phonetic analyzer is configured to compress the index value prior to transmission.

13. The system of claim 11, wherein the receiving device includes a second dictionary and a dictionary controller for receiving the index value and the corresponding digitized signal and storing the index value and the corresponding index value in the second dictionary.

14. The system of claim 11, wherein the receiving device includes a second dictionary and a dictionary controller, and wherein the receiving device, upon detecting an index value that matches to an index value in the second dictionary, is configured to retrieve the corresponding digitized signal from the second dictionary.

15. The system of claim 11, wherein the phonetic analyzer assigns index values that are indicative of the corresponding digitized signals such that index values assigned to similar digitized signals are similar and index values assigned to dissimilar digitized signals are dissimilar.

16. The system of claim 15, wherein, upon detecting an index value that fails to match to an index value in the secondary dictionary, the dictionary controller determines a closest matching index value and retrieves the digitized signal corresponding to closest matching index value from the second dictionary.

17. The system of claim 11, wherein the phonetic analyze is further configured to assign an index value to a sequence of digitized signals including a first digitized signal corresponding to a first entry in the first dictionary and a second digitized signal corresponding to a second entry in the digitized signal and to transmit the index value to the receiving device in lieu of the sequence of digitized signals.

18. A computer program product comprising a set of instructions configured on a computer readable medium for transmitting audio information, the set of instructions comprising:

means for generating a set of dictionary digitized signals and a corresponding set of index values;

means for comparing a received digitized audio signal to the set of dictionary digitized signals;

means for transmitting, upon detecting a match between the received digitized signal and the set of dictionary digitized signals, the index value corresponding to the matching dictionary digitized signal; and means for assigning, upon detecting no match between the digitized signal and any of the first dictionary entries, an index value to the digitized signal and storing the digitized signal and the corresponding assigned index value in an entry of the first dictionary.

19. The computer program product of claim 18, wherein the means for generating the dictionary digitized signals and the corresponding set of index values assigns index values that are indicative of the corresponding digitized signals such that index values assigned to similar digitized signals are similar and index values assigned to dissimilar digitized signals are dissimilar.

20. The computer program product of claim 19, wherein, the means for generating the dictionary digitized signals, upon detecting an index value that fails to match to an index value in the secondary dictionary, determines a closest matching index value and retrieves the digitized signal corresponding to closest matching index value from the second dictionary.

21. The computer program product of claim 18, wherein the means for generating the dictionary digitized signals is further configured to assign an index value to a sequence of digitized signals including a first digitized signal corresponding to a first entry in the dictionary digitized signals and a second digitized signal corresponding to a second entry in the dictionary digitized signals.

* * * * *